US009732755B2

(12) United States Patent
Rood et al.

(10) Patent No.: US 9,732,755 B2
(45) Date of Patent: Aug. 15, 2017

(54) ORBITING CRANKSHAFT DRIVE PIN AND ASSOCIATED DRIVE PIN SLEEVE GEOMETRY

(71) Applicant: Trane International Inc., Piscataway, NJ (US)

(72) Inventors: Jerry Allen Rood, Onalaska, WI (US); Michael Gerard Benco, Onalaska, WI (US); Scott Joseph Smerud, La Crosse, WI (US); Wayne Gerard Gorski, La Crosse, WI (US); Keith Adam Novak, Holmen, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 214 days.

(21) Appl. No.: 14/448,338

(22) Filed: Jul. 31, 2014

(65) Prior Publication Data

US 2015/0037185 A1 Feb. 5, 2015

Related U.S. Application Data

(60) Provisional application No. 61/860,318, filed on Jul. 31, 2013.

(51) Int. Cl.
*F04C 29/00* (2006.01)
*F04C 18/02* (2006.01)
(Continued)

(52) U.S. Cl.
CPC ..... *F04C 29/0057* (2013.01); *F01C 17/063* (2013.01); *F01C 21/02* (2013.01); *F04C 18/0215* (2013.01); *F04C 23/001* (2013.01); *F04C 2240/52* (2013.01); *F04C 2240/601* (2013.01); *Y10T 74/211* (2015.01)

(58) Field of Classification Search
CPC ..... F04C 29/0057; F04C 18/0215; F04C 2240/601; F01C 21/02; Y10T 74/211
See application file for complete search history.

(56) References Cited

U.S. PATENT DOCUMENTS 4,836,758 A 6/1989 Elson et al.
5,174,738 A 12/1992 Baumann et al.
(Continued)

FOREIGN PATENT DOCUMENTS

JP 07197890 A * 8/1995 ..... F04C 18/02

OTHER PUBLICATIONS

English language machine translation of JP 07197890.*

*Primary Examiner* — Mark Laurenzi
*Assistant Examiner* — Wesley Harris
(74) *Attorney, Agent, or Firm* — Hamre, Schumann, Mueller & Larson, P.C.

(57) ABSTRACT

A compressor crankshaft assembly includes a crankshaft and an eccentric drive pin extending from one end of the crankshaft. The shape of the drive pin viewed into the exposed end of the drive pin is defined by the intersection of a first cylinder that is coaxial with the axis of a substantially cylindrical orbital bearing journaled and installed to receive the eccentric drive pin and a second cylinder that is coaxial with the axis of a substantially cylindrical main bearing journaled and installed to rotatably receive the crankshaft, such that the area defined by the intersecting portion is less than the area defined by either cylinder.

20 Claims, 4 Drawing Sheets

(51) Int. Cl.

| | |
|---|---|
| ***F01C 21/02*** | (2006.01) |
| ***F01C 17/06*** | (2006.01) |
| ***F04C 23/00*** | (2006.01) |

(56) References Cited

U.S. PATENT DOCUMENTS

| | | | | |
|---|---|---|---|---|
| 5,439,360 | A | 8/1995 | Barito | |
| 5,496,158 | A | 3/1996 | Barito et al. | |
| 6,203,300 | B1 | 3/2001 | Williams et al. | |
| 6,354,822 | B1 | 3/2002 | Lifson et al. | |
| 6,585,502 | B2 | 7/2003 | Fenocchi | |
| 7,247,009 | B2 | 7/2007 | Sun | |
| 7,273,363 | B1 | 9/2007 | Sun et al. | |
| 7,766,633 | B2 | 8/2010 | Nakamura et al. | |
| 8,308,461 | B2 | 11/2012 | Kuwahara et al. | |
| 2003/0063982 | A1* | 4/2003 | Pham | F04C 23/008 417/292 |
| 2004/0052666 | A1* | 3/2004 | Cho | F04B 39/1073 417/569 |
| 2006/0204378 | A1* | 9/2006 | Anderson | F04C 18/0215 417/410.5 |

* cited by examiner

ORBITING CRANKSHAFT DRIVE PIN AND ASSOCIATED DRIVE PIN SLEEVE GEOMETRY

FIELD

The embodiments described herein relate generally to compressors. More particularly, the embodiments described herein relate to an orbiting crankshaft drive pin and associated bearing sleeve geometry.

BACKGROUND

One increasingly popular type of compressor is a scroll compressor. In a scroll compressor, a pair of scroll members orbits relative to each other to compress an entrapped refrigerant.

In typical scroll compressors, a first, stationary, scroll member has a base and a generally spiral wrap extending from its base. A second, orbiting, scroll member has a base and a generally spiral wrap extending from its base. The second, orbiting, scroll member is driven to orbit by a rotating shaft. An eccentric pin on the rotating shaft may extend into a slider block which is received within a boss on a rear face of the second, orbiting, scroll member. This geometry disadvantageously allows radial movement of the slider block.

Some scroll compressors employ an orbital bearing that is offset from the rotating crankshaft main bearings. Such scroll compressors disadvantageously require that the associated crankshaft main bearing system be assembled from the end of the crankshaft opposite the end of the crankshaft having the eccentric pin.

SUMMARY

In view of the foregoing, there is a need for a compressor crankshaft drive pin, crankshaft drive pin sleeve, and associated drive pin sleeve geometry that is capable of both creating an orbiting motion without compromising the integrity of the drive pin and allowing assembly of a crankshaft main bearing via the drive pin end of the crankshaft.

According to one embodiment, a compressor crankshaft assembly comprises a substantially cylindrical main bearing. A crankshaft is rotatably disposed at least partially within the substantially cylindrical main bearing. The crankshaft assembly further comprises a substantially cylindrical orbital bearing, an eccentric drive pin extending from one end of the crankshaft, and a drive pin sleeve affixed to the eccentric drive pin. Use of the term "affixed" is intended to mean, that once assembled, the drive pin sleeve is not intended to move relative to the eccentric drive pin during the compressor's lifetime. The eccentric drive pin and the drive pin sleeve are rotatably disposed at least partially within the substantially cylindrical orbital bearing. The shape of the drive pin viewed into the exposed end of the drive pin is defined by the intersection of a cylinder that is coaxial with the axis of the orbital bearing and a cylinder that is coaxial with the axis of the main bearing such that the area defined by the intersecting portion is less than the area defined by either cylinder.

In some embodiments, the "areas" referred to above are areas defined by a cross sectional area perpendicular to the longitudinal axis of the respective cylinders. For example, the area may also refer to a cross-sectional area of the drive pin or of the intersection of the two cylinders.

According to another embodiment, a compressor crankshaft assembly comprises a crankshaft and an eccentric drive pin extending from one end of the crankshaft. The shape of the drive pin viewed into the exposed end of the drive pin is defined by the intersection of a first cylinder that is coaxial with the axis of a substantially cylindrical orbital bearing journaled and installed to receive the eccentric drive pin and a second cylinder that is coaxial with the axis of a substantially cylindrical main bearing journaled and installed to rotatably receive the crankshaft, such that the area defined by the intersecting portion is less than the area defined by either cylinder.

According to yet another embodiment, a compressor crankshaft assembly comprises a horizontal main bearing housing comprising a fluid inlet and a fluid outlet. A first, input stage is disposed within the horizontal main bearing housing and is configured to receive and compress a fluid via the fluid inlet. The first, input stage comprises a first, fixed scroll member and a first, orbiting scroll member in meshing engagement with the fixed scroll member. A second, output stage is disposed within the horizontal main bearing housing and is configured to further compress and discharge the fluid via the fluid outlet. The second, output stage comprises a second, fixed scroll member and a second orbiting scroll member in meshing engagement with the second, fixed scroll member. A crankshaft is rotatably journaled in one or more main bearings disposed within the horizontal main bearing housing. The crankshaft comprises a first eccentric drive pin extending from a first end of the crankshaft such that the first eccentric drive pin engages the first, orbiting scroll member. The crankshaft further comprises a second eccentric drive pin extending from a second end of the crankshaft such that the second eccentric drive pin engages the second, orbiting scroll member. The shape of at least one drive pin viewed into the exposed end of the drive pin is defined by the intersection of a respective cylinder that is coaxial with the axis of a substantially cylindrical orbital bearing journaled and installed to receive the eccentric drive pin and a second cylinder that is coaxial with the axis of a substantially cylindrical main bearing journaled and installed to rotatably receive the crankshaft, such that the area defined by the intersecting portion is less than the area defined by either cylinder.

According to still another embodiment, a compressor crankshaft assembly comprises a main bearing housing and a crankshaft rotatably journaled in one or more main bearings disposed within the main bearing housing. The crankshaft comprises a first eccentric drive pin extending from one end of the crankshaft, wherein the shape of the first eccentric drive pin viewed into the exposed end of the first eccentric drive pin is defined by the intersection of a respective cylinder that is coaxial with the axis of a substantially cylindrical orbital bearing journaled and installed to receive the first eccentric drive pin and a second cylinder that is coaxial with the axis of a substantially cylindrical main bearing journaled and installed to rotatably receive the crankshaft, such that the area defined by the intersecting portion is less than the area defined by either cylinder.

DRAWINGS

These and other features, aspects, and advantages of the orbiting crankshaft drive pin and associated bearing sleeve geometry will become better understood when the following detailed description is read with reference to the accompanying drawing, wherein.

Figure 1:
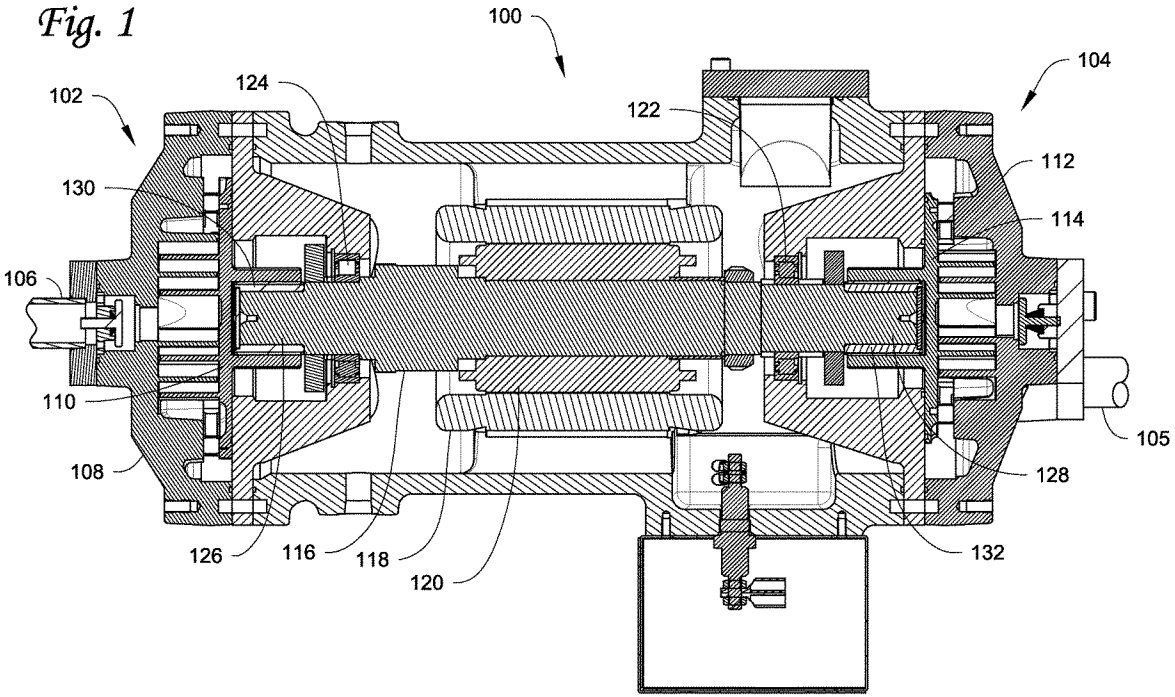
FIG. 1 is a side sectional view illustrating a two-stage scroll compressor, according to one embodiment.

While the above-identified drawing figures set forth particular embodiments, other embodiments of the orbiting crankshaft drive pin and associated bearing sleeve geometry are also contemplated, as noted in the discussion. In all cases, this disclosure presents illustrated embodiments of the orbiting crankshaft drive pin and associated eccentric drive pin sleeve geometry by way of representation and not limitation. Numerous other modifications and embodiments can be devised by those skilled in the art which fall within the scope and spirit of the principles of the orbiting crankshaft drive pin and associated eccentric drive pin sleeve geometry described herein.

DETAILED DESCRIPTION

Although particular embodiments are described herein with respect to scroll compressors, it will be appreciated the principles described herein are not so limited, and may just as easily be applied to other types of compressors, such as, without limitation, reciprocating compressors. Looking now at FIG. 1, a two-stage horizontal scroll compressor 100 is illustrated in perspective view, according to one embodiment. Although the embodiments are described herein with reference to horizontal scroll compressors, the principles described herein may just as easily be applied to vertical scroll compressors. Further, it will be appreciated that the principles described herein may be applied to single stage and multi-stage compressors, as well as parallel flow compressors that for example are not serial flow (e.g. two stage machines).

Scroll compressor 100 comprises a first, input stage 102 and a second, output stage 104. The first, input stage 102 comprises a suction side input 106. First, input stage 102 further comprises a fixed, non-orbiting scroll member 108 and an orbiting scroll member 110. Non-orbiting scroll member 108 is positioned in meshing engagement with orbiting scroll member 110.

The second, output stage 104 comprises an input 105, which receives refrigerant from the first stage discharge side. Second, output stage 104 further comprises a fixed, non-orbiting scroll member 112 and an orbiting scroll member 114. Non-orbiting scroll member 112 is positioned in meshing engagement with orbiting scroll member 114.

Scroll compressor 100 further comprises a compressor drive shaft or crankshaft 116 extending between the first, input stage 102 and the second, output stage 104. The crankshaft 116 may be rotatably driven via an electric motor comprising windings 118 and a rotor 120 press-fit on the compressor crankshaft 116. The crankshaft 116 may be rotatably journaled within one or more journals onto which inner races of main bearings 122, 124 can be mounted. Each crankshaft main bearing 122, 124 may comprise a rolling element bearing having a generally cylindrical portion.

The compressor crankshaft 116 further may comprise a first eccentric drive pin 126 disposed at its first, input stage end. The compressor crankshaft 116 may further comprise a second eccentric drive pin 128 disposed at its second, output stage end. Each eccentric drive pin 126, 128 may be disposed within a drive pin sleeve 130, 132 that is placed over a respective drive pin 126, 128. The scroll compressor 100 may then operate to provide an orbiting motion of one of two intermeshing scrolls 108, 110 and/or 112, 114 via the drive pin sleeve 130, 132 that is placed over its respective eccentric drive pin 126, 128.

Figure 2:
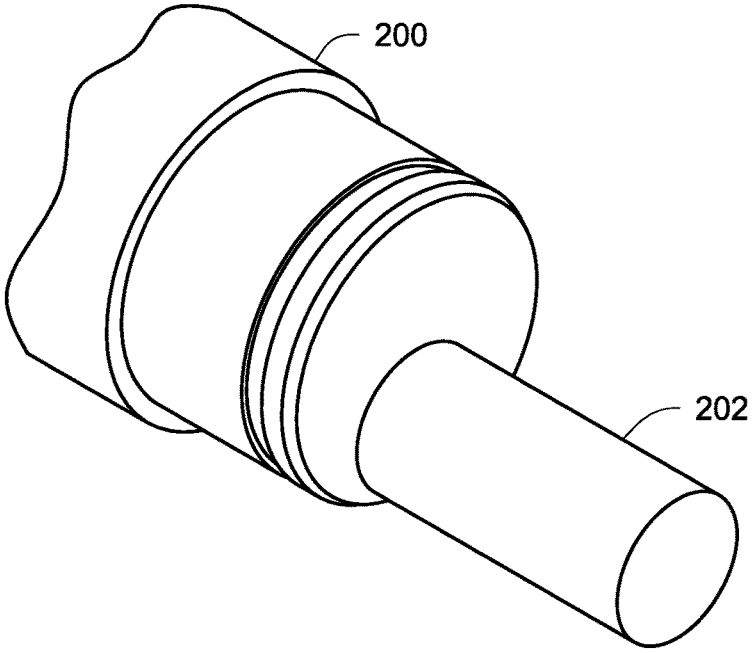
FIG. 2 is a perspective view illustrating a compressor crankshaft with an eccentric drive pin, according to one embodiment.
Figure 3:
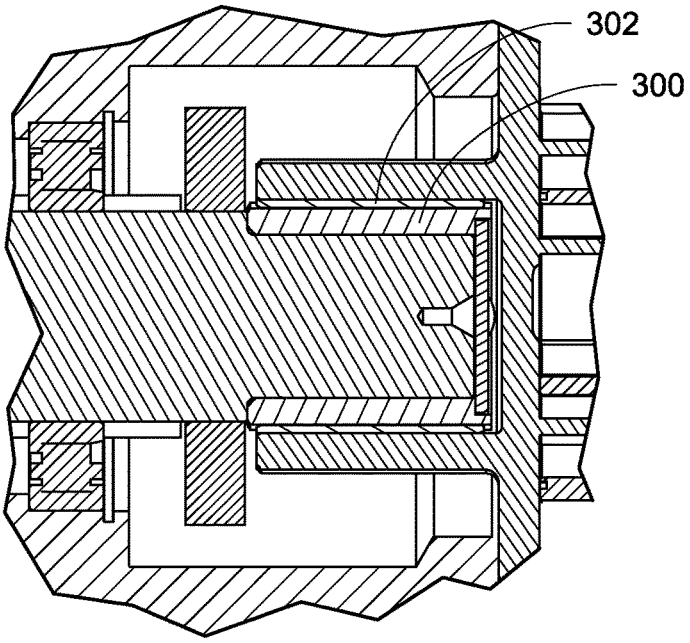
FIG. 3 is a perspective view illustrating an eccentric drive pin sleeve attached to the eccentric drive pin depicted in FIG. 2, according to one embodiment.

FIG. 2 is a perspective view illustrating one end of a compressor crankshaft 200, which may be used as the crankshaft 116 in FIG. 1, with an eccentric drive pin 202, according to one embodiment; while FIG. 3 is a perspective view illustrating in more detail, a drive pin sleeve 300 attached to the eccentric drive pin 202 depicted in FIG. 2, according to one embodiment. A scroll compressor uses an orbiting motion in the compression process, as stated herein. The drive pin sleeve 300 that is offset from the center of rotation of the crankshaft 200 creates the orbiting motion. The size and alignment of this sleeve 300 can impact its function and reliability; but the offset journal size for the desired and suitable functionality of the orbiting sleeve bearing, can complicate the assembly of the main bearing to the crankshaft 200.

Figure 4A:
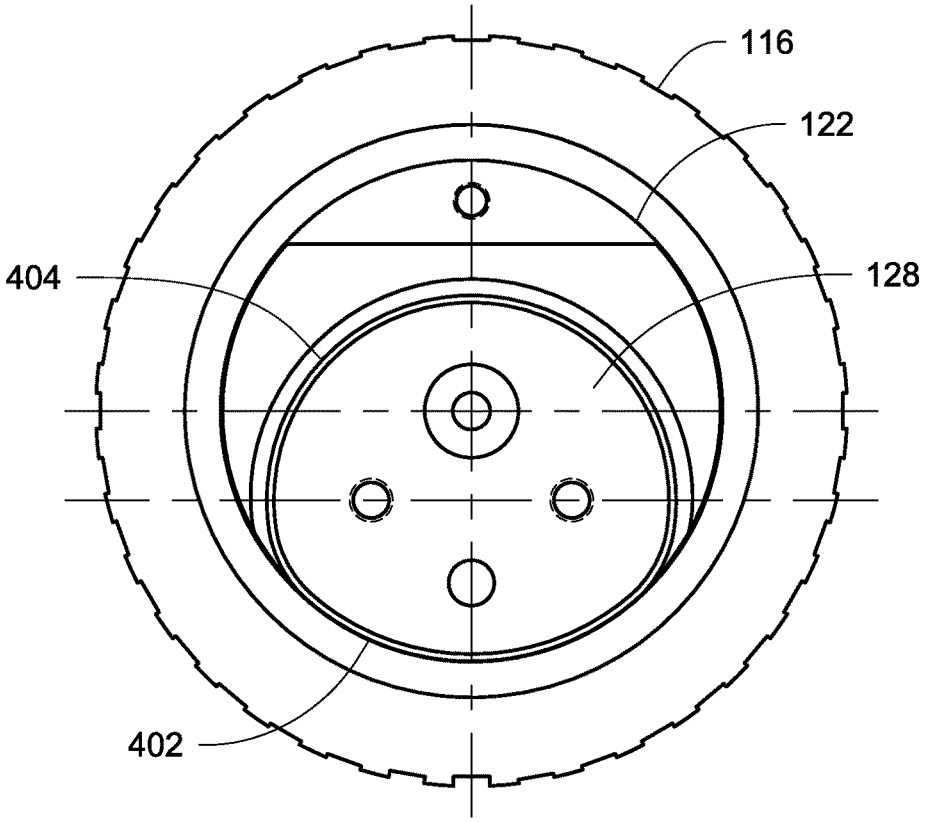
FIGS. 4A and 4B are a cross-sectional views of a compressor crankshaft drive pin viewed from one end of the crankshaft and a corresponding eccentric drive pin sleeve, according to one embodiment.
Figure 4B:
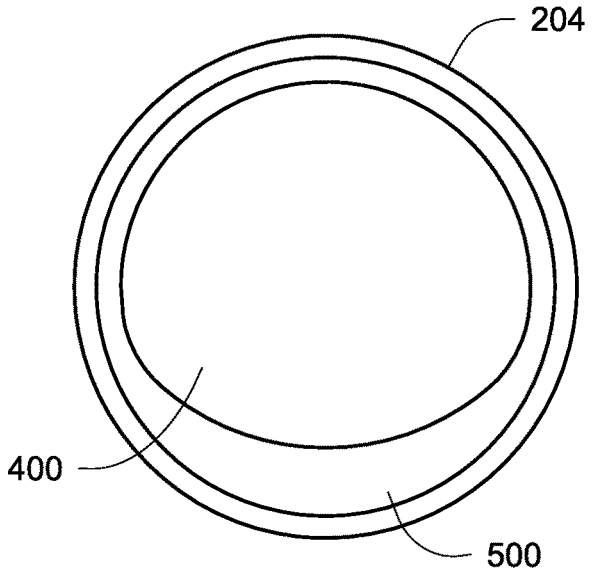

As shown in FIGS. 3 and 4A-B, for example, the orbital bearing 204 (see FIG. 4B) can have a bearing sleeve/bushing 302 (see FIG. 3), into which the eccentric journal (journal surface of e.g. drive pin sleeve 132 referred to in FIG. 1) rotatably fits, which can be the outer diameter of the eccentric drive pin sleeve 300 of FIG. 3. Although the eccentric drive pin 202 and its associated drive pin sleeve 300 provide an assembly that allows both adequate size of the orbital bearing 204, and allows assembly of the crankshaft main bearing, this structure may disadvantageously compromise the integrity and alignment of the orbital bearing 204 due to excessive drive forces in the compressor 100 that may bend the drive pin 202.

The orbital bearing, e.g. orbital bearing 204, can be comprised of the bearing sleeve 302, the eccentric journal portion of the eccentric drive pin sleeve 300, the clearance between the sleeve and the journal, and perhaps, the oil filling the clearance between the two parts. The bearing sleeve/bushing 302 of FIG. 3 is one part of the orbital bearing, and may also be called an "orbital bearing bushing" or an "orbital bearing insert" for example.

The eccentric drive pin/drive pin sleeve configurations described in further detail herein with reference to FIGS. 4A-B, result in reduced drive pin deflection characteristics by maximizing the cross-sectional area of the drive pin(s) 126, 128 when viewed into one end of the eccentric drive pin(s). This maximized cross-sectional area advantageously still permits assembly of the compressor crankshaft main bearing(s) 122, 124 onto the crankshaft 116 from the eccentric drive pin end(s) of the crankshaft 116 by confining the drive pin(s) 126, 128 to be within the inner diameter of the crankshaft bearing(s) 122, 124.

Looking now at FIGS. 4A-B, a cross-sectional view of a compressor crankshaft drive pin 128 is viewed from one end of the crankshaft 116, according to one embodiment. It will be appreciated that the principles described herein apply just as well to the drive pin 126 at the opposite end of the crankshaft 116, and so the description herein will be limited to the drive pin 128 end of the crankshaft 116 to preserve brevity and to enhance clarity in understanding the embodiments described herein with reference to FIGS. 4A-B.

Figure 5A:
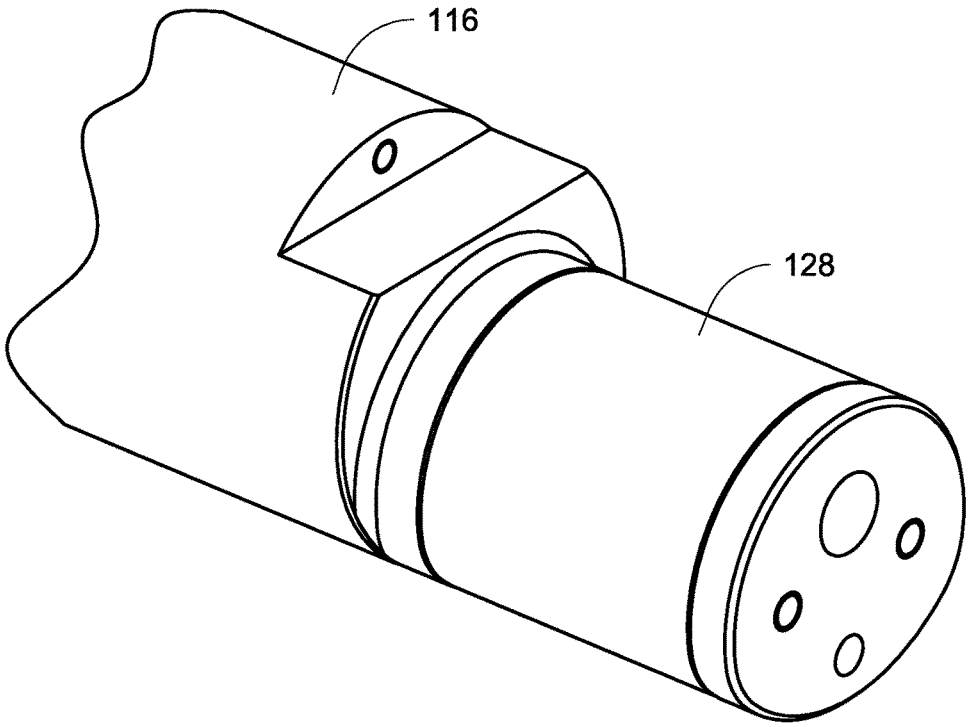
FIGS. 5A and 5B are a perspective views illustrating an eccentric drive pin sleeve associated with an eccentric drive pin, according to one embodiment.
Figure 5B:
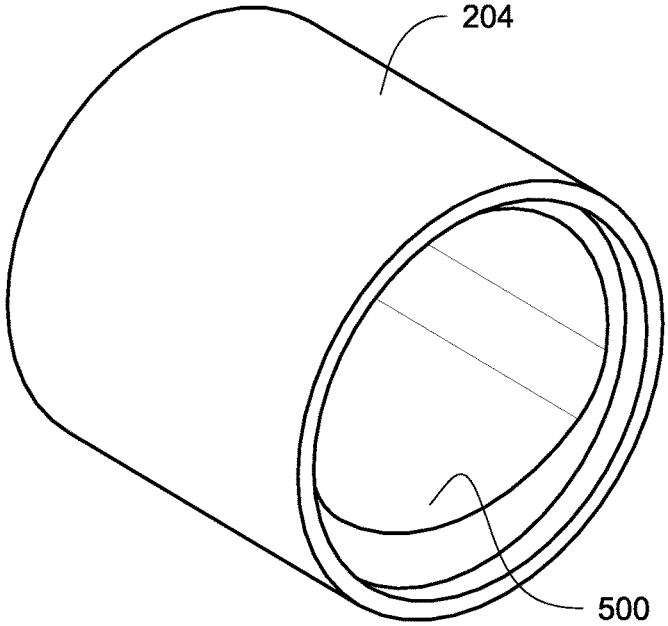

The eccentric drive pin 128 extends from one end of the compressor crankshaft 116 as shown more clearly in FIGS. 5A-B. The drive pin 128 end of the crankshaft 116 may be rotatable within one or more main bearings 122, 124 coupled to the crankshaft 116. It will be appreciated that the main bearings could be constructed as any suitable bearing including but not limited to cylindrical roller bearings, ball bearings, tapered roller bearings, or journal bearings. The shaft and eccentric drive pin sleeve 500 may be rotatable within a substantially cylindrical orbital bearing sleeve/bushing 302 as shown in FIG. 3. As shown, the shaft and eccentric drive pin sleeve are inserted into the orbital bearing sleeve 302 with a clearance fit. The shaft and sleeve 500 can then rotate within the orbital bearing sleeve 302 and orbital bearing. The shape of the drive pin 128 viewed into one end of the drive pin 128 is defined by the intersection of a cylinder that is coaxial with the axis of the orbital bearing 204 and a cylinder that is coaxial with the axis of the main bearing, such as the surface of the journal onto which is mounted e.g. main bearing 122, such that the area defined by the intersecting portion 400 is less than the total area defined by either cylinder. The eccentric drive pin 128 thus may comprise a first arcuate portion 402 defined by the radius of the cylinder that is coaxial with the main bearing 122, e.g. surface of journal onto which main bearing 122 is mounted, and a second arcuate portion 404 defined by the radius of the cylinder that is coaxial with the orbital bearing 204.

FIGS. 5A-B are a perspective view illustrating the drive pin sleeve 500 next to the eccentric drive pin 128, according to one embodiment, with the appreciation that it can have similarities with the sleeve 300 shown in FIG. 3. The drive pin sleeve 500 comprises a substantially cylindrical outer circumference allowing a suitable fit to accommodate an orbital bearing sleeve, such as insert 302. The inner periphery of the drive pin sleeve 500 is configured with a shape that is based on the foregoing intersecting portion 400 allowing a suitable fit to accommodate the eccentric drive pin 128.

The foregoing eccentric drive pin 128 and drive pin sleeve 500 geometries described with reference to FIGS. 4A-B and 5A-B function together to reduce drive pin deflection by maximizing the cross-sectional area of the eccentric drive pin 128 while still permitting a crankshaft main bearing 122 to be assembled onto the crankshaft 116 from the drive pin 128 end of the crankshaft 116. The maximized cross-sectional area of the eccentric drive pin 128 results in a drive pin 128 having an outer periphery that is constrained to be within the inner diameter of the crankshaft bearing 122, thus allowing installation of a crankshaft main bearing.

In summary explanation, an eccentric drive pin and sleeve structure maximizes the size of the eccentric drive pin and still permits assembly of a crankshaft and main bearing for a crankshaft comprising the eccentric drive pin. The eccentric drive pin shape is defined by the intersection of a cylinder that is coaxial with an orbiting/orbital bearing associated with the eccentric drive pin, and a cylinder that is defined by the crankshaft main bearing diameter. For example, the drive pin shape could be slightly smaller than the intersection of the two cylinders, e.g. confined by the intersection, and still be larger than typical drive pins. The inner periphery of an eccentric drive pin sleeve has a corresponding shape so that it can be placed over the eccentric pin, thus allowing assembly of the crankshaft main bearing, assembly of the orbital/orbiting bearing, and resulting in minimal eccentric drive pin deflection.

Maximizing or at least increasing the size of the eccentric drive pin advantageously improves functionality and reliability of the associated orbiting/orbital bearing. More specifically, maximizing or at least increasing the size of the eccentric drive pin advantageously prevents bending of the eccentric drive pin to a point where the alignment of the orbiting/orbital bearing is compromised. The embodiments described herein advantageously prevent loss of lubricant film thickness and bearing failure.

It will be appreciated that the drive pin and associated drive pin sleeve geometry can be applied to parallel flow machines, such as parallel flow compressors in which there is not a serial flow of the fluid, e.g. refrigerant, to be compressed such as shown in FIG. 1. Parallel flow machines are known, where each compression stage may have its own inlet and outlet, where the outlet of one stage does not necessarily flow into the inlet of another stage, such as shown in FIG. 1. That is, the compressor of FIG. 1 may be modified such that the outlet of the first stage does not flow into the second stage and that inlet of the second stage received fluid to be compressed from a source other than from the first stage.

It will be appreciated that any of aspects 1 to 5 may be combined with any of aspects 6 to 22, and any of aspects 6 to 10 may be combined with any of aspects 11 and 22, and any of aspects 11 and 12 may be combined with any of aspects 13 to 22, and any of aspects 13 to 21 may be combined with aspect 22.

Aspect 1. A compressor crankshaft assembly comprising: a substantially cylindrical main bearing; a crankshaft rotatably disposed at least partially within the substantially cylindrical main bearing; a substantially cylindrical orbital bearing; and an eccentric drive pin extending from one end of the crankshaft and rotatably disposed at least partially within the substantially cylindrical orbital bearing, wherein the shape of the drive pin viewed into the exposed end of the drive pin is defined by the intersection of a cylinder that is coaxial with the axis of the orbital bearing and a cylinder that is coaxial with the axis of the main bearing such that the area defined by the intersecting portion is less than the area defined by either cylinder.

Aspect 2. The compressor crankshaft assembly according to aspect 1, further comprising an eccentric drive pin sleeve pressed, or shrunk around, or fixedly attached to the eccentric drive pin.

Aspect 3. The compressor crankshaft assembly according to aspect 1 or 2, further comprising an eccentric drive pin sleeve between the orbital bearing and the eccentric drive pin, wherein the drive pin sleeve includes an inside surface shaped so as to receive the eccentric drive pin, the inside surface being defined by the intersection of the cylinder that is coaxial with the axis of the orbital bearing and the cylinder that is coaxial with the axis of the main bearing.

Aspect 4. The compressor crankshaft assembly according to any of aspects 1 to 3, wherein the crankshaft is disposed within a horizontal compressor.

Aspect 5. The compressor crankshaft assembly according to any of aspects 1 to 4, wherein the crankshaft is disposed within a vertical compressor.

Aspect 6. A compressor crankshaft assembly comprising: a crankshaft; and an eccentric drive pin extending from one end of the crankshaft, wherein the shape of the drive pin viewed into the exposed end of the drive pin is defined by the intersection of a first cylinder that is coaxial with the axis of a substantially cylindrical orbital bearing journaled and installed to receive the eccentric drive pin and a second cylinder that is coaxial with the axis of a substantially cylindrical main bearing journaled and installed to rotatably receive the crankshaft, such that the area defined by the intersecting portion is less than the area defined by either cylinder.

Aspect 7. The compressor crankshaft assembly according to aspect 6, further comprising a drive pin sleeve configured to receive the eccentric drive pin, the shape of the drive pin sleeve being defined by the intersection of the first and second cylinders.

Aspect 8. The compressor crankshaft assembly according to aspect 7, further comprising an orbital bearing that rotatably receives the drive pin sleeve.

Aspect 9. The compressor crankshaft assembly according to any of aspects 6 to 8, wherein the crankshaft is disposed within a horizontal compressor.

Aspect 10. The compressor crankshaft assembly according to any of aspects 6 to 9, wherein the crankshaft is disposed within a vertical compressor.

Aspect 11. A compressor assembly comprising: a horizontal main bearing housing comprising a fluid inlet and a fluid outlet; a first, input stage disposed within the horizontal main bearing housing and configured to receive and compress a fluid via the fluid inlet, the first, input stage comprising: a first, fixed scroll member; and a first, orbiting scroll member in meshing engagement with the fixed scroll member; a second, output stage disposed within the horizontal main bearing housing and configured to further compress and discharge the fluid via the fluid outlet, the second, output stage comprising: a second, fixed scroll member; and a second orbiting scroll member in meshing engagement with the second, fixed scroll member; a crankshaft rotatably journaled in one or more main bearings disposed within the horizontal main bearing housing, the crankshaft comprising: a first eccentric drive pin extending from a first end of the crankshaft such that the first eccentric drive pin engages the first, orbiting scroll member; and a second eccentric drive pin extending from a second end of the crankshaft such that the second eccentric drive pin engages the second, orbiting scroll member, wherein the shape of at least one drive pin viewed into the exposed end of the drive pin is defined by the intersection of a respective cylinder that is coaxial with the axis of a substantially cylindrical orbital bearing journaled and installed to receive the eccentric drive pin and a second cylinder that is coaxial with the axis of a substantially cylindrical main bearing journaled and installed to rotatably receive the crankshaft, such that the area defined by the intersecting portion is less than the area defined by either cylinder.

Aspect 12. The compressor assembly according to aspect 11, further comprising a respective drive pin sleeve that receives an eccentric drive pin for each eccentric drive pin having a shape defined by the intersection of a respective first and second cylinder, such that the respective drive pin sleeve is defined by the intersection of the respective first and second cylinders.

Aspect 13. A compressor crankshaft assembly comprising: a main bearing housing; and a crankshaft rotatably journaled in one or more main bearings disposed within the main bearing housing, the crankshaft comprising: a first eccentric drive pin extending from one end of the crankshaft, wherein the shape of the first eccentric drive pin viewed into the exposed end of the first eccentric drive pin is defined by the intersection of a respective cylinder that is coaxial with the axis of a substantially cylindrical orbital bearing journaled and installed to receive the first eccentric drive pin and a second cylinder that is coaxial with the axis of a substantially cylindrical main bearing journaled and installed to rotatably receive the crankshaft, such that the area defined by the intersecting portion is less than the area defined by either cylinder.

Aspect 14. The compressor crankshaft assembly according to aspect 13, wherein the main bearing housing comprises a scroll compressor main bearing housing.

Aspect 15. The compressor crankshaft assembly according to aspect 14, wherein the scroll compressor main bearing housing comprises a two-stage scroll compressor main bearing housing.

Aspect 16. The compressor crankshaft assembly according to any of aspects 13 to 15, further comprising a second eccentric drive pin extending from the opposite end of the crankshaft, wherein the shape of the second eccentric drive pin viewed into the exposed end of the second eccentric drive pin is defined by the intersection of a respective cylinder that is coaxial with the axis of a substantially cylindrical orbital bearing journaled and installed to receive the second eccentric drive pin and a second cylinder that is coaxial with the axis of a substantially cylindrical main bearing journaled and installed to rotatably receive the crankshaft, such that the area defined by the intersecting portion is less than the area defined by either cylinder.

Aspect 17. The compressor crankshaft assembly according to any of aspects 13 to 16, wherein the main bearing housing comprises a reciprocating compressor main bearing housing.

Aspect 18. The compressor crankshaft assembly according to any of aspects 13 to 17, wherein the main bearing housing and the crankshaft together are associated with a vertical compressor.

Aspect 19. The compressor crankshaft assembly according to aspect 18, wherein the vertical compressor is selected from a scroll compressor and a reciprocating compressor.

Aspect 20. The compressor crankshaft assembly according to any of aspects 13 to 19, wherein the main bearing housing and the crankshaft together are associated with a horizontal compressor.

Aspect 21. The compressor crankshaft assembly according to aspect 20, wherein the horizontal compressor comprises a two-stage scroll compressor.

Aspect 22. A parallel-flow compressor assembly comprising: a horizontal main bearing housing; a first stage disposed within the horizontal main bearing housing and configured to receive and compress a fluid via a fluid inlet and discharge the fluid via a fluid outlet, the first stage comprising: a first, fixed scroll member; and a first, orbiting scroll member in meshing engagement with the fixed scroll member; a second stage disposed within the horizontal main bearing housing and configured to receive and compress a fluid via a fluid inlet and discharge the fluid via a fluid outlet, the second stage comprising: a second, fixed scroll member; and a second orbiting scroll member in meshing engagement with the second, fixed scroll member; a crankshaft rotatably journaled in one or more main bearings disposed within the horizontal main bearing housing, the crankshaft comprising: a first eccentric drive pin extending from a first end of the crankshaft such that the first eccentric drive pin engages the first, orbiting scroll member; and a second eccentric drive pin extending from a second end of the crankshaft such that the second eccentric drive pin engages the second, orbiting scroll member, wherein the shape of at least one drive pin viewed into the exposed end of the drive pin is defined by the intersection of a respective cylinder that is coaxial with the axis of a substantially cylindrical orbital bearing journaled and installed to receive the eccentric drive pin and a second cylinder that is coaxial with the axis of a substantially cylindrical main bearing journaled and installed to rotatably receive the crankshaft, such that the area defined by the intersecting portion is less than the area defined by either cylinder.

While the embodiments have been described in terms of various specific embodiments, those skilled in the art will recognize that the embodiments can be practiced with modification within the spirit and scope of the claims.

What is claimed is:

1. A compressor crankshaft assembly comprising:

a cylindrical main bearing;

a crankshaft rotatably disposed at least partially within the cylindrical main bearing;

a cylindrical orbital bearing; and an eccentric drive pin extending from one end of the crankshaft and rotatably disposed at least partially within the cylindrical orbital bearing, wherein a shape of the drive pin viewed into an end of the drive pin is defined by a common portion formed by a first cylinder overlapping with a second cylinder, the common portion includes a first arcuate portion which is defined by a radius of the first cylinder and a second arcuate portion which is defined by a radius of the second cylinder, the radius of the second cylinder is greater than the radius of the first cylinder, a cross section of the common portion is asymmetrical relative to a horizontal central axis of the first cylinder and is asymmetrical relative to a horizontal central axis of the second cylinder, the first cylinder is coaxial with the cylindrical orbital bearing, and the second cylinder is coaxial with the cylindrical main bearing.

2. The compressor crankshaft assembly according to claim 1, further comprising an eccentric drive pin sleeve pressed, or shrunk around, or fixedly attached to the eccentric drive pin.

3. The compressor crankshaft assembly according to claim 1, further comprising an eccentric drive pin sleeve between the cylindrical orbital bearing and the eccentric drive pin, wherein an inner periphery of the eccentric drive pin sleeve is configured with a shape to receive the eccentric drive pin.

4. The compressor crankshaft assembly according to claim 1, wherein the crankshaft is disposed within one of a horizontal compressor or a vertical compressor.

5. The compressor crankshaft assembly according to claim 1, wherein the shape of the eccentric drive pin extends in an axial direction of the crankshaft from an end of the eccentric drive pin, the end of the eccentric drive pin extending from the one end of the crankshaft extend to a distal end of the eccentric drive pin.

6. The compressor crankshaft assembly according to claim 1, wherein the common portion includes a majority of the first cylinder and a majority of the second cylinder.

7. A compressor crankshaft assembly comprising:

a crankshaft;

a cylindrical orbital bearing;

a cylindrical main bearing; and an eccentric drive pin extending from one end of the crankshaft, wherein a shape of the drive pin viewed into an end of the drive pin is defined by a common portion formed by a first cylinder overlapping with a second cylinder, the common portion includes a first arcuate portion which is defined by a radius of the first cylinder and a second arcuate portion which is defined by a radius of the second cylinder, the radius of the second cylinder is greater than the radius of the first cylinder, a cross section of the common portion is asymmetrical relative to a horizontal central axis of the first cylinder and is asymmetrical relative to a horizontal central axis of the second cylinder, and the first cylinder is coaxial with the cylindrical orbital bearing, and the second cylinder is coaxial with the cylindrical main bearing.

8. The compressor crankshaft assembly according to claim 7, further comprising a drive pin sleeve, wherein an inner periphery of the drive pin sleeve is configured with a shape to receive the eccentric drive pin.

9. The compressor crankshaft assembly according to claim 8, wherein the cylindrical orbital bearing rotatably receives the drive pin sleeve.

10. The compressor crankshaft assembly according to claim 7, wherein the crankshaft is disposed within one of a horizontal compressor or a vertical compressor.

11. A compressor assembly comprising:

a horizontal main bearing housing comprising a fluid inlet and a fluid outlet;

a first, input stage disposed within the horizontal main bearing housing and configured to receive and compress a fluid via the fluid inlet, the first, input stage comprising:

a first, fixed scroll member; and a first, orbiting scroll member in meshing engagement with the fixed scroll member;

a second, output stage disposed within the horizontal main bearing housing and configured to further compress and discharge the fluid via the fluid outlet, the second, output stage comprising:

a second, fixed scroll member; and a second orbiting scroll member in meshing engagement with the second, fixed scroll member;

a cylindrical main bearing;

a cylindrical orbital bearing; and a crankshaft rotatably journaled in the cylindrical main bearing, which is disposed within the horizontal main bearing housing, the crankshaft comprising:

a first eccentric drive pin extending from a first end of the crankshaft such that the first eccentric drive pin engages the first, orbiting scroll member; and a second eccentric drive pin extending from a second end of the crankshaft such that the second eccentric drive pin engages the second, orbiting scroll member, wherein a shape of at least one of the first eccentric drive pin and the second eccentric drive pin viewed into an end thereof is defined by a common portion formed by a first cylinder overlapping with a second cylinder, the common portion includes a first arcuate portion which is defined by a radius of the first cylinder and a second arcuate portion which is defined by a radius of the second cylinder, the radius of the second cylinder is greater than the radius of the first cylinder, a cross section of the common portion is asymmetrical relative to a horizontal central axis of the first cylinder and is asymmetrical relative to a horizontal central axis of the second cylinder, the first cylinder is coaxial with the cylindrical orbital bearing, which is journaled and installed to receive the at least one of the first eccentric drive pin and the second eccentric drive pin, and the second cylinder is coaxial with the cylindrical main bearing, which is journaled and installed to rotatably receive the crankshaft.

12. The compressor assembly according to claim 11, further comprising a respective drive pin sleeve that receives the at least one of the first eccentric drive pin and the second eccentric drive pin, wherein an inner periphery of the respective drive pin sleeve is configured with a shape to receive the at least one of the first eccentric drive pin and the second eccentric drive pin.

13. A compressor crankshaft assembly comprising:

a main bearing housing;

a cylindrical main bearing;

a cylindrical orbital bearing; and a crankshaft rotatably journaled in the cylindrical main bearing, the cylindrical main bearing being disposed within the main bearing housing, the crankshaft comprising:

a first eccentric drive pin extending from one end of the crankshaft, wherein a shape of the first eccentric drive pin viewed into an end of the first eccentric drive pin is defined by a common portion formed by a first cylinder overlapping with a second cylinder, the common portion includes a first arcuate portion which is defined by a radius of the first cylinder and a second arcuate portion which is defined by a radius of the second cylinder, the radius of the second cylinder is greater than the radius of the first cylinder, a cross section of the common portion is asymmetrical relative to a horizontal central axis of the first cylinder and is asymmetrical relative to a horizontal central axis of the second cylinder, the first cylinder is coaxial with the cylindrical orbital bearing, which is journaled and installed to receive the first eccentric drive pin, and the second cylinder is coaxial with the cylindrical main bearing, which is journaled and installed to rotatably receive the crankshaft.

14. The compressor crankshaft assembly according to claim 13, wherein the main bearing housing comprises a scroll compressor main bearing housing.

15. The compressor crankshaft assembly according to claim 14, wherein the scroll compressor main bearing housing comprises a two-stage scroll compressor main bearing housing.

16. The compressor crankshaft assembly according to claim 13, further comprising a second eccentric drive pin extending from the opposite end of the crankshaft, a second cylindrical main bearing, and a second cylindrical orbital bearing, wherein the shape of the second eccentric drive pin viewed into an end of the second eccentric drive pin is defined by a common portion formed by a first cylinder overlapping with a second cylinder, the common portion includes a first arcuate portion which is defined by a radius of the first cylinder and a second arcuate portion which is defined by a radius of the second cylinder, the radius of the second cylinder is greater than the radius of the first cylinder, a cross section of the common portion is asymmetrical relative to a horizontal central axis of the first cylinder and is asymmetrical relative to a horizontal central axis of the second cylinder, the first cylinder is coaxial with an axis of the second cylindrical orbital bearing, which is journaled and installed to receive the second eccentric drive pin, and the second cylinder is coaxial with an axis of the second cylindrical main bearing, which is journaled and installed to rotatably receive the crankshaft.

17. The compressor crankshaft assembly according to claim 13, wherein the main bearing housing and the crankshaft together are associated with a vertical compressor, and the vertical compressor is a scroll compressor.

18. The compressor crankshaft assembly according to claim 13, wherein the main bearing housing and the crankshaft together are associated with a horizontal compressor.

19. The compressor crankshaft assembly according to claim 18, wherein the horizontal compressor comprises a two-stage scroll compressor.

20. A parallel-flow compressor assembly comprising:

a horizontal main bearing housing;

a first stage disposed within the horizontal main bearing housing and configured to receive and compress a fluid via a fluid inlet and discharge the fluid via a fluid outlet, the first stage comprising:

a first, fixed scroll member; and a first, orbiting scroll member in meshing engagement with the fixed scroll member;

a second stage disposed within the horizontal main bearing housing and configured to receive and compress a fluid via a fluid inlet and discharge the fluid via a fluid outlet, the second stage comprising:

a second, fixed scroll member; and a second orbiting scroll member in meshing engagement with the second, fixed scroll member;

one or more cylindrical main bearings;

a cylindrical orbital bearing; and a crankshaft rotatably journaled in the one or more cylindrical main bearings, the one or more cylindrical main bearings being disposed within the horizontal main bearing housing, the crankshaft comprising:

a first eccentric drive pin extending from a first end of the crankshaft such that the first eccentric drive pin engages the first, orbiting scroll member; and a second eccentric drive pin extending from a second end of the crankshaft such that the second eccentric drive pin engages the second, orbiting scroll member, wherein a shape of at least one of the first eccentric drive pin and the second eccentric drive pin viewed into an end thereof is defined by a common portion formed by a first cylinder overlapping with a second cylinder, the common portion includes a first arcuate portion which is defined by a radius of the first cylinder and a second arcuate portion which is defined by a radius of the second cylinder, the radius of the second cylinder is greater than the radius of the first cylinder, a cross section of the common portion is asymmetrical relative to a horizontal central axis of the first cylinder and is asymmetrical relative to a horizontal central axis of the second cylinder, the first cylinder is coaxial with the cylindrical orbital bearing, which is journaled and installed to receive the at least one of the first eccentric drive pin and the second eccentric drive pin, and the second cylinder is coaxial with the one or more cylindrical main bearings, journaled and installed to rotatably receive the crankshaft.

* * * * *